US006112357A

United States Patent [19]

Halloran

[11] Patent Number: 6,112,357

[45] Date of Patent: Sep. 5, 2000

[54] EXTENDIBLE GOLF BRUSH

[76] Inventor: Richard Halloran, 34 Elm St., Andover, Mass. 01810

[21] Appl. No.: 09/179,072

[22] Filed: Oct. 26, 1998

[51] Int. Cl.[7] ..... A46B 15/00

[52] U.S. Cl. ..... 15/106; 15/161; 15/200; 15/DIG. 6; 24/3.1

[58] Field of Search ..... 15/106, 161, 200, 15/DIG. 6; 242/379, 379.2, 384.7, 385.4, 323, 404.3; 24/3.1, 116 A, 3.13, 324, 300; 273/32 B; 473/408

[56] References Cited

U.S. PATENT DOCUMENTS

| | | |
|---|---|---|
| D. 339,473 | 9/1993 | Lewis et al. . |
| 5,230,117 | 7/1993 | Johnson et al. . |
| 5,450,954 | 9/1995 | Dunn . |
| 5,458,267 | 10/1995 | Curtis et al. . |
| 5,555,589 | 9/1996 | Moultrie . |
| 5,596,785 | 1/1997 | Park . |
| 5,815,873 | 10/1998 | Jones . |

*Primary Examiner*—Terrence R. Till
*Assistant Examiner*—Jennifer McNeil
*Attorney, Agent, or Firm*—O'Connell Law Office

[57] ABSTRACT

An extendible golf brush comprising a tether housing, a flexible bent arm for fastening the tether housing to an external article, a tether extendibly contained within the tether housing, a brush member, and a mechanism for removably fastening a second end of the tether to the brush member. A second end of the flexible bent arm may comprise a first hook for engaging a second hook that is fixed to the tether housing. The mechanism for removably fastening the second end of the tether to the brush member may comprise a fastening mouth with a base member and first and second fastening jaws hingedly connected to the base member for capturing the brush member. Distal ends of the first and second fastening jaws can be selectively fastened together by a male member in combination with a female member. The brush member may be fastened directly to the fastening mouth or it may be coupled thereto by a ring. Both plastic and bronze bristles may project from the brush member to provide varied brushing characteristics. The tether housing may be formed from lightweight plastic halves that retain a lightweight plastic spool, and the tether may comprise a nylon chord.

17 Claims, 3 Drawing Sheets

EXTENDIBLE GOLF BRUSH

FIELD OF THE INVENTION

The present invention relates generally to devices for cleaning debris from golf clubs and golf shoes. More particularly, the invention disclosed herein relates to a golf brush that may be securely but removably coupled to a golf bag by an extendible tether.

BACKGROUND OF THE INVENTION

It must be recognized at the outset that the prior art discloses a plurality of attempts at providing devices for cleaning golf clubs and golf shoes. Among these is a relatively small group of brush devices that are designed to be retained exterior to a golf bag so that a user need not fumble through the pockets of his or her golf bag in search of a needed golf brush. Among that group of devices is a still smaller group of brushes that are retained on the exterior of a golf bag along an extendible, spring-biased tether. With such brushes, a golfer is able to clean his or her golf equipment, such as shoes or golf clubs, without being required to remove the device from the golf bag. When the brush is needed, the golfer merely draws the brush away from the bag thereby extending the tether to allow ready cleaning of golf equipment. When the brush is no longer needed, the golfer simply allows the biased tether to retract the brush to a position adjacent to the golf bag.

Unfortunately, however, prior art brush devices suffer from a plurality of disadvantages. One major disadvantage derives from the method of attachment of prior art devices. For example, certain prior art devices are designed to be attached to a golf bag by a resilient clip member that may be slid over, for example, an upper edge of the golf bag. These devices can exhibit unintentional disattachment from the golf bag, which can lead to a loss of the golf brush.

Furthermore, certain other brush designs are attached to a golf bag by a means that is not subject to ready disattachment from a golf bag. This can be particularly disadvantageous when one seeks to transfer the device from one golf bag to another or when one needs to replace or clean part or all of the golf brush.

Still further, many prior art golf brushes are less than ideal because the brush portion of the device is not readily detachable from the remainder of the device. Also, one will note that many prior art golf brushes employ brush portions that are unique to that particular device. As a result, when the brush portion of the golf brush must be replaced in either such device, the golfer is compelled to replace the entire device instead of only the brush portion, which certainly would be preferred.

Yet further, the inventor has realized that an arguably most important disadvantage exhibited by substantially all prior art devices is that they are manufactured employing such parts and materials that they are too expensive to enjoy widespread commercial success. Consequently, even where such devices function effectively, their expense has been found to diminish their commercial success whereby the devices often fall from the market's view shortly after their introduction.

In light of the foregoing, it becomes clear that a golf brush presenting a solution to one or more of the aforementioned problems exhibited by the prior art would be useful. However, it is still clearer that a device presenting a solution to each and every one of the aforementioned problems while exhibiting a number of heretofore-unrealized advantages would represent a marked advance in the art.

SUMMARY OF THE INVENTION

Advantageously, the present invention has a principal object of providing an extendible golf brush that is constructed simply and from inexpensive constituent parts whereby the device is durable and effective yet capable of being made available to the public at a reasonable cost.

A further object of the invention is to provide an extendible golf brush that can be securely fastened to an external article, such as a golf bag, while remaining readily removable and replaceable relative to the golf bag.

A related object of the invention is to provide an extendible golf brush that can be separated into constituent parts to allow a user to remove and replace individual parts of the golf brush as circumstances require.

Yet another object of the invention is to provide an extendible golf brush that employs a brush member that can be readily procured to allow ready replacement of the brush member relative to the extendible golf brush.

Undoubtedly, these and further objects and inherent advantages of the present invention will become readily apparent both to one who reviews the present specification and the accompanying drawings and to one who has an opportunity to make use of an embodiment of the present invention.

In accomplishing the aforementioned objects, the present invention essentially comprises an extendible golf brush for cleaning debris from golf equipment. In a most basic embodiment, the extendible golf brush comprises a tether housing, a means for removably fastening the tether housing to an external article, a tether extendibly contained within the tether housing, a brush member comprising a body portion and a plurality of bristles that extend from the body portion, and a means for removably fastening a second end of the tether to the brush member.

In certain embodiments, the means for removably fastening the tether housing to an external article may comprise a flexible bent fastening arm. The flexible bent fastening arm may have a first end fixedly joined to the tether housing and a second end, which may comprise a hook, that can be selectively retained by a receiving mechanism, which also may comprise a hook, that is disposed within an alcove on the tether housing. With this, the flexible bent fastening arm can fasten the tether housing securely to an external article thereby accomplishing the invention's object of securely but removably capturing an element of an external article.

To accomplish the invention's goal of securely but removably retaining the brush member most effectively, the means for removably fastening the second end of the tether to the brush member may take the form of a fastening mouth with a first fastening jaw with a proximal end and a distal end, a second fastening jaw with a proximal end and a distal end, and a means for selectively fastening the distal end of the first fastening jaw to the distal end of the second fastening jaw.

Ideally, the fastening mouth will further comprise a base member, the first fastening jaw will be hingedly coupled to the base member along a first hinge, and the second fastening jaw will be hingedly coupled to the base member along a second hinge. Under this arrangement, the invention's goals are achieved still more effectively since the first and second fastening jaws can be pivoted to a closed position for securely capturing the brush member and the first and second fastening jaws can be pivoted to an open position for releasing the brush member.

Preferably, the means for selectively fastening the distal end of the first fastening jaw to the distal end of the second fastening jaw will comprise a male member fixed to the first fastening jaw adjacent to the distal end of the first fastening jaw and a female member fixed to the second fastening jaw adjacent to the distal end of the second fastening jaw. With this, the male and female members can be readily engaged to retain the brush member and readily disengaged to release the brush member.

Although the fastening mouth could be directly associated with the body portion of the brush member, it may be preferable to include further a ring with an annular body portion that is mutually received within the fastening mouth and through the body portion of the brush member. Such a connection will, among other things, allow for a more flexible connection between the second end of the tether and the brush member.

It is possible that the brush member could pursue many different embodiments while remaining within the scope of the present invention. However, in preferred embodiments the brush member will be of a type that can be readily procured when a given brush member must be replaced. For example, an ideal brush member will be of the type with an elongate body portion with a plurality of plastic bristles fixedly projecting from a first brushing area and a plurality of bronze bristles fixedly projecting from a second brushing area. Such a brush member is advantageous also because it presents two markedly different brushing areas for accommodating different cleaning needs.

Similarly, the tether housing could assume a plurality of embodiments. However, in furtherance of the invention's explicit goal of providing an extendible golf brush that is simple and inexpensive while remaining effective in use and light in weight, the tether housing may be formed from the union of a first half that is crafted from lightweight plastic and a second half that is similarly crafted from a lightweight plastic. With this, the invention will enjoy lightweight while demonstrating durability and simple functionality. Still further, the tether housing may include a plastic spool rotatably disposed between the first and second halves, and the tether may comprise a nylon chord with a first end fixed to the plastic spool.

Of course, one reading the present disclosure will realize that the foregoing discussion broadly outlines the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF A PREFERRED EMBODIMENT

Figure 1:
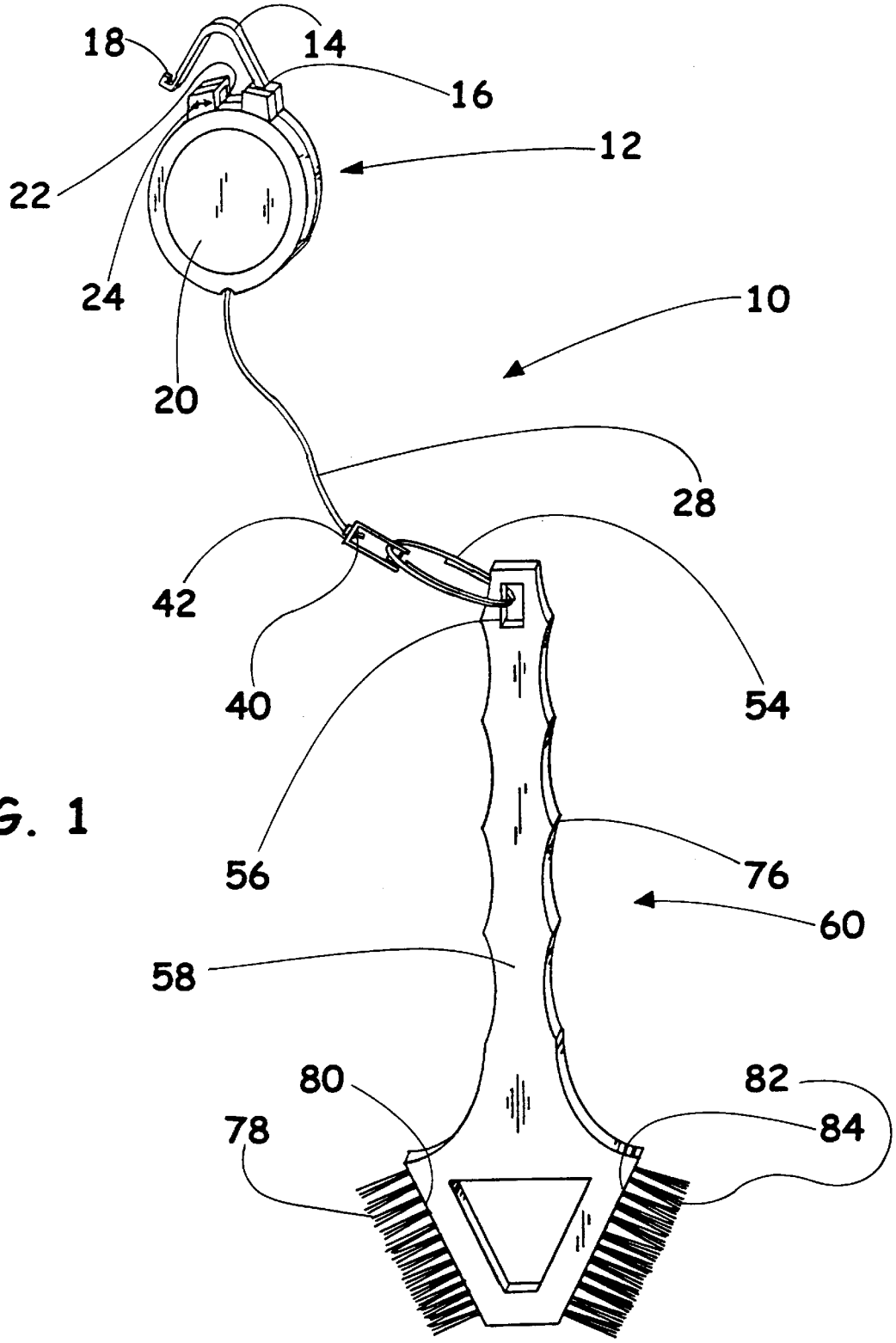
FIG. 1 is a perspective view of an extendible golf brush according to the present invention.

To aid in a more complete understanding of the invention and to ensure that one reviewing the present disclosure would be enabled to practice the invention, a preferred embodiment of the extendible golf brush is indicated generally at 10 in FIG. 1. In FIG. 1, the extendible golf brush 10 is shown to include a lightweight tether housing 12 that is founded upon a main body portion 20. A flexible, bent fastening arm 14 has a first end 16 that is fixed to the main body portion 20 of the tether housing 12 and a second end 18 that comprises a hook, which is also indicated at 18.

Figure 2:
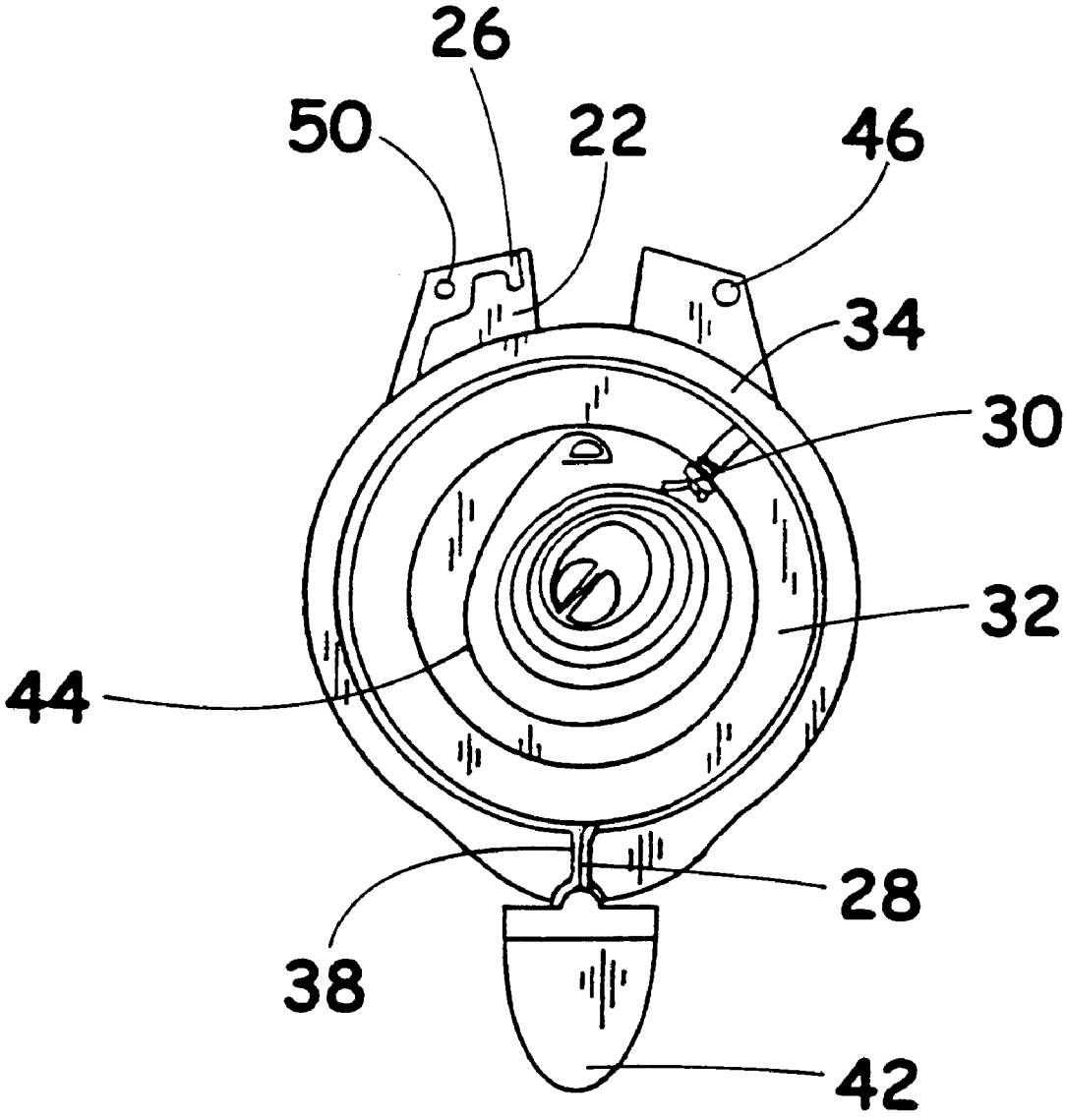
FIG. 2 is a view in front elevation of a first half of a tether housing according to the present invention.
Figure 3:
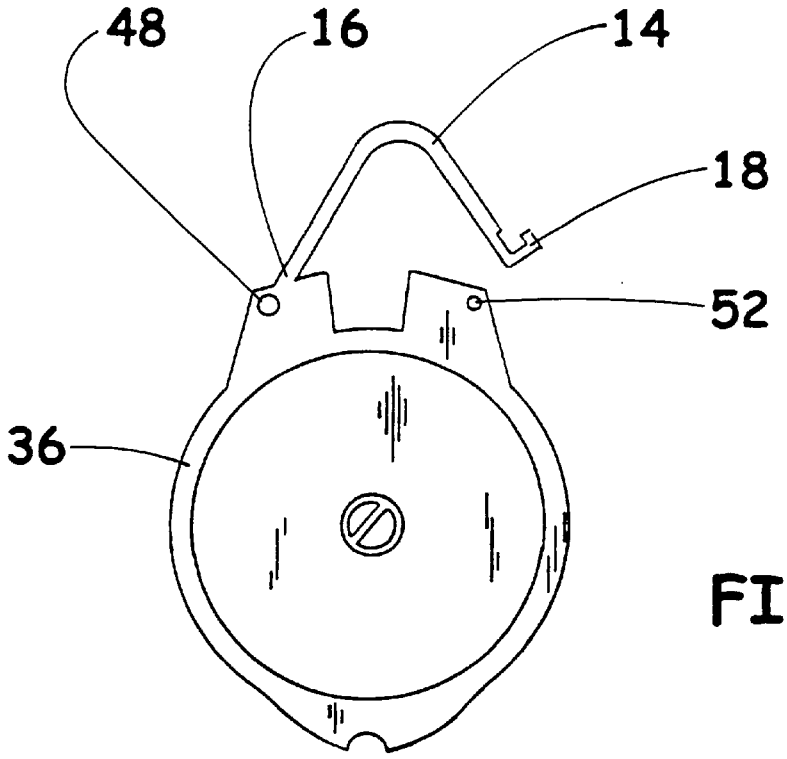
FIG. 3 is a view in front elevation of a second half of a tether housing according to the present invention.

In use, as one can see best through a combined reference to FIGS. 1, 2, and 3, the fastening arm 14 is able to capture an element (e.g., a ring) of an external article (e.g., a golf bag), neither of which are shown. To do so, as the arrows 24 indicate, a user will press the second end 18 of the fastening arm 14 away from a hook 26 of a hook alcove 22 in which the second end 18 is normally retained and toward the first end 16 of the fastening arm 14. With this, the hook 18 will be disengaged from the hook 26 of the hook alcove 22.

A user can then bend the fastening arm 14 to an open position as is shown in FIG. 1 to allow the second end 18 of the flexible arm 14 to pass through, for example, a ring of a golf bag to which the extendible golf brush 10 is to be attached. With a ring of a golf bag captured, the second end 18 of the flexible fastening arm 14 can be re-inserted into the hook alcove 22 and then released to allow the hook 18 to engage the hook 26 in a mating arrangement. With this, the extendible golf brush 10 will be securely fastened to the external article. Advantageously, however, the extendible golf brush 10 can be readily removed from the external article by merely reversing the aforementioned process.

A tether 28 extends from the tether housing 12 opposite the fastening arm 14. Ideally, the tether 28 is formed from a strong but lightweight nylon chord. As FIGS. 2 and 3 show, the tether 28 has a first end 30 fixedly retained by a spool 32 that is rotatably retained between a first half 34 and a second half 36 of the tether housing 12. The tether 28 is wrapped around the spool 32 for a given number of rotations before exiting the tether housing 12 through a passageway 38. Looking to FIG. 2 and back to FIG. 1, one sees that a second end 40 of the tether 28 is fastened to a fastening mouth 42 as by tying a knot in the second end 40 of the tether 28. The spool 32 is biased to retract the tether 28 from an extended position to the position depicted in FIG. 2 by a helical metal spring 44.

Advantageously, the tether housing 12 is rendered most simple and inexpensive in construction by being formed by the coupling of the first half 34 and the second half 36. Each of the halves 34 and 36 is unitarily formed from, ideally, a lightweight plastic or the like. The first and second halves 34 and 36 are joined by a snap-fit male/female engagement between the annular halves 34 and 36 and between a rod 46 on the first half 34 with a hole 48 in the second half 36 and a hole 50 in the first half 34 with a rod 52 on the second half 36. As such, the tether housing 12 is both simple and inexpensive in manufacture whereby the extendible golf brush 10 can be made available to the consuming public at an exceedingly reasonable cost.

Figure 4:
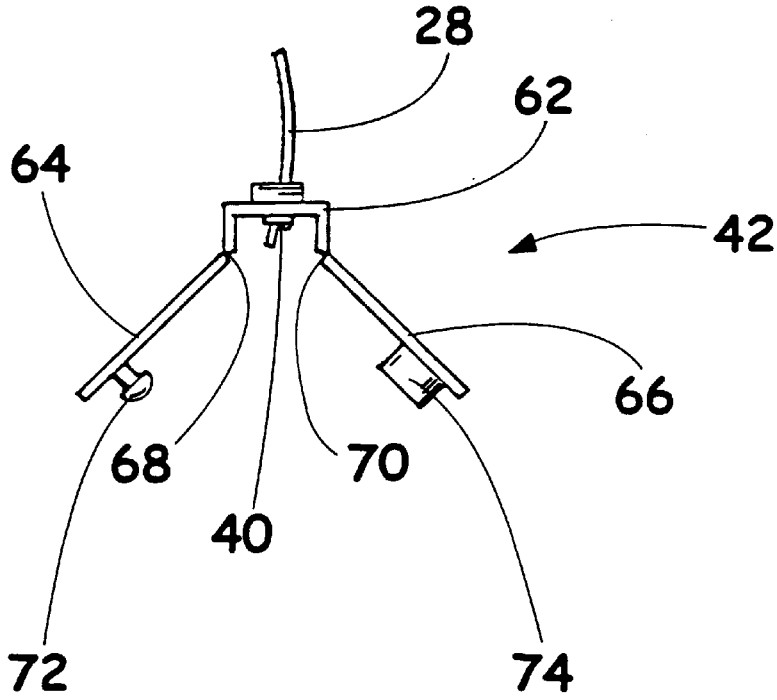
FIG. 4 is a view in side elevation of a fastening mouth according to the present invention.

As FIG. 1 shows most clearly, the fastening mouth 42, which is fastened to the second end 40 of the tether 28, enables the second end 40 of the tether 28 to be fastened securely but readily removably to a ring 54 that has an annular body portion that also passes through an aperture 56 in a body portion 58 of a brush member 60. Looking to FIG. 4, one sees that the fastening mouth 42 comprises a base member 62 that is coupled to a first fastening jaw 64 by a first hinge 68 and to a second fastening jaw 66 by a second hinge 70. A male member 72 is disposed on the first fastening jaw 64 adjacent to the distal end thereof, and a female member 74 is disposed on the second fastening jaw 66 in alignment with the male member 72.

In use, the first and second fastening jaws 64 and 66 can be pivoted about the first and second hinges 68 and 70 to cause the male member 72 to engage the female member 74 and thereby to capture the body portion of the ring 54. With this, the brush member 60 is securely fastened to the second end 40 of the tether 28. However, the brush member 60 and the second end 40 of the tether 28 can be separated readily by simply pulling the male member 72 from within the female member 74 to allow the ring 54 to be removed.

Looking more particularly to the presently preferred brush member 60 of FIG. 1, one sees that the brush member 60 comprises a readily available brush member 60 that includes an elongate body portion 58 that has a plurality of ergonomic gripping ridges 76 disposed thereon. With the elongate body portion 58 and the ergonomic gripping ridges 76, a user can enjoy exemplary leverage to allow a most effective cleaning of golf equipment. Most importantly, of course, a distal end of the brush member 60 has a plethora of nylon bristles 78 projecting from a first brushing area 80 and a plethora of bronze bristles 82 projecting from a second brushing area 84. With this, a user is able to select from two unique brushing characteristics of the bronze bristles 82 and the nylon bristles 78, 11. One will note that the first and second brushing areas 80 and 84 are disposed at equal and opposite angles relative to the elongate body portion 58 of the brush member 60 such that the first and second brushing areas 80 and 84 assume a V-shaped configuration for allowing a user greater leverage in cleaning his or her golf equipment.

From the foregoing, one will realize that the present invention enjoys a multiplicity of advantages over the prior art. For example, with its efficient construction, the tether housing 12 assists the invention in providing an extendible golf brush 10 that is durable and effective yet capable of being made available to the public at a reasonable cost. Furthermore, with the benefit of the fastening arm 14, the extendible golf brush 10 can be securely fastened to an external article, such as a golf bag, while remaining readily removable and replaceable relative to the golf bag. Still further, by use of the fastening arm 14 and the fastening mouth 42, the present invention enables a user to separate the invention into its constituent parts to permit the removal and replacement of individual parts of the extendible golf brush 10 as circumstances require. Furthermore, by employing a brush member 60 of a type that can be readily procured, the invention allows a user to replace the brush member 60 without needing to replace the entire extendible golf brush 10. Undoubtedly, one who has reviewed the present disclosure will be aware of still further benefits and advantages of the present invention.

Although the invention has been shown and described with reference to a certain preferred embodiment, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

I claim as deserving the protection of United States Letters Patent:

1. An extendible golf brush for cleaning debris from golf equipment, the extendible golf brush comprising:

a tether housing;

a means for removably fastening the tether housing to an external article;

a tether extendibly contained within the tether housing wherein the tether has a first end fixedly coupled to the tether housing and a second end that is free and wherein the tether is extendible to an extended position but biased to a retracted position;

a brush member comprising a body portion and a plurality of bristles that extend from the body portion; and a means for removably fastening the second end of the tether to the brush member;

wherein the means for removably fastening the tether housing to an external article comprises a flexible fastening arm with a first end fixedly joined to the tether housing and a second end selectively retainable by a receiving mechanism on the tether housing whereby the flexible fastening arm can securely but removably capture an element of an external article to fasten the tether housing securely to the external article.

2. The extendible golf brush of claim 1 wherein the second end of the flexible fastening arm comprises a first hook and wherein the receiving mechanism on the tether housing comprises a second hook fixed to the tether housing.

3. The extendible golf brush of claim 2 wherein the second hook of the tether housing is disposed within an alcove on the tether housing.

4. The extendible golf brush of claim 1 wherein the brush member comprises an elongate body portion with a plurality of plastic bristles fixedly projecting from a first brushing area of the brush member and a plurality of bronze bristles fixedly projecting from a second brushing area of the brush member whereby the brush member presents two markedly different brushing areas for accommodating different cleaning needs.

5. The extendible golf brush of claim 4 wherein the first and second brushing areas are disposed at opposite sides of a distal end of the brush member.

6. The extendible golf brush of claim 5 wherein each of the first and second brushing areas are disposed at an angle relative to the elongate body portion of the brush member.

7. The extendible golf brush of claim 6, wherein the first and second brushing areas are disposed at equal and opposite angles relative to the elongate body portion of the brush member such that the first and second brushing areas assume a V-shaped configuration.

8. The extendible golf brush of claim 1 wherein the tether housing comprises a first half that is formed from lightweight plastic and that is fixedly joined to a second half that is formed from a lightweight plastic.

9. The extendible golf brush of claim 8 wherein the tether housing further comprises a plastic spool rotatably disposed between the first and second halves, wherein the tether comprises a nylon chord, and wherein the first end of the tether is fixed to the plastic spool.

10. An extendible golf brush for cleaning debris from golf equipment, the extendible golf brush comprising:

a tether housing;

a means for removably fastening the tether housing to an external article;

a tether extendible contained within the tether housing wherein the tether has a first end fixedly coupled to the tether housing and a second end that is free and wherein the tether is extendible to an extended position but biased to a retracted position;

a brush member comprising a body portion and a plurality of bristles that extend from the body portion; and a means for removably fastening the second end of the tether to the brush member wherein the means for removably fastening the second end of the tether to the brush member comprises a fastening mouth with a first fastening jaw with a proximal end and a distal end, a second fastening jaw with a proximal end and a distal end, and a means for selectively fastening the distal end of the first fastening jaw to the distal end of the second fastening jaw whereby the fastening mouth can securely but removably capture the brush member.

11. The extendible golf brush of claim 10 wherein the fastening mouth further comprises a base member and wherein the first fastening jaw is hingedly coupled to the base member along a first hinge and the second fastening jaw is hingedly coupled to the base member along a second hinge whereby the first and second fastening jaws can be pivoted to a closed position for securely capturing the brush member and whereby the first and second fastening jaws can be pivoted to an open position for releasing the brush member.

12. The extendible golf brush of claim 11 wherein the means for selectively fastening the distal end of the first fastening jaw to the distal end of the second fastening jaw comprises a male member fixed to the first fastening adjacent to the distal end of the first fastening jaw and a female member fixed to the second fastening jaw adjacent to the distal end of the second fastening jaw.

13. The extendible golf brush of claim 10 further comprising a ring with an annular body portion mutually received within the fastening mouth and through the body portion of the brush member.

14. An extendible golf brush for cleaning debris from golf equipment, the extendible golf brush comprising:

a tether housing;

a receiving mechanism comprising a hook that is integrally formed with the tether housing;

a flexible fastening arm with a first end fixedly joined to the tether housing and a second end comprising a hook that can be selectively retained by the receiving mechanism whereby the flexible fastening arm can securely but removably capture an element of an external article to fasten the tether housing to an external article by an engagement of the hook at the second end of the flexible fastening arm with the hook of the receiving mechanism on the tether housing;

a tether extendibly contained within the tether housing wherein the tether has a first end fixedly coupled to the tether housing and a second end that is free and wherein the tether is extendible to an extended position but biased to a retracted position;

a brush member comprising a body portion and a plurality of bristles that extend from the body portion; and a means for removably fastening the second end of the tether to the brush member comprising a fastening mouth with a first fastening jaw with a proximal end and a distal end, a second fastening jaw with a proximal end and a distal end, and a means for selectively fastening the distal end of the first fastening jaw to the distal end of the second fastening jaw whereby the fastening mouth can securely but removably capture the brush member.

15. The extendible golf brush of claim 14 wherein the hook of the tether housing is disposed within an alcove on the tether housing.

16. The extendible golf brush of claim 14 wherein the fastening mouth further comprises a base member and wherein the first fastening jaw is hingedly coupled to the base member along a first hinge and the second fastening jaw is hingedly coupled to the base member along a second hinge whereby the first and second fastening jaws can be pivoted to a closed position for securely capturing the brush member and whereby the first and second fastening jaws can be pivoted to an open position for releasing the brush member.

17. The extendible golf brush of claim 14 wherein the means for selectively fastening the distal end of the first fastening jaw to the distal end of the second fastening jaw comprises a male member fixed to the first fastening adjacent to the distal end of the first fastening jaw and a female member fixed to the second fastening jaw adjacent to the distal end of the second fastening jaw.

* * * * *